US006098307A

United States Patent [19]

Pikus et al.

[11] Patent Number: 6,098,307

[45] Date of Patent: Aug. 8, 2000

[54] METHOD FOR TREATING STARCH AND STARCH-BEARING PRODUCTS

[75] Inventors: Ilya Pikus, Plymouth; Greg Kimball, Circle Pines; Kevin Burns, Roseville, all of Minn.

[73] Assignee: Hosokawa Bepex Corporation, Minneapolis, Minn.

[21] Appl. No.: 09/198,668

[22] Filed: Nov. 23, 1998

[51] Int. Cl.[7] ..... F26B 3/08

[52] U.S. Cl. ..... 34/368; 34/369; 34/373; 34/503

[58] Field of Search ..... 34/179, 181, 182, 34/183, 500, 503, 368, 369, 373; 99/409, 421 H, 630

[56] References Cited

U.S. PATENT DOCUMENTS 4,770,236 9/1988 Kulikowski ..... 165/86
5,271,163 12/1993 Pikus ..... 34/33
5,634,282 6/1997 Pikus ..... 34/266
5,711,089 1/1998 Pikus ..... 34/267

*Primary Examiner*—Pamela A. Wilson
*Attorney, Agent, or Firm*—Piper, Marbury, Rudnick & Wolfe

[57] ABSTRACT

A method for treating material comprising starch and starch-bearing products wherein the products are introduced to a thermal processor comprising a housing defining an inner wall surface, an inlet end, an outlet end, and an agitator rotatable within the housing adapted to direct the material into contact with the inner wall surface. The inner wall surface is heated and nozzles associated with the agitator are used for discharging fluid from the nozzles into contact with the material during rotation of the agitator. Heating to obtain treatment of the material is provided by contact with the inner wall surface and by controlling the fluid discharge from the nozzles to create turbulence for spreading the material over a broad surface area of the inner wall surface to enhance and render substantially uniform the heat exchange between the material, the fluid, and the inner wall surface, and to control mass transfer between the fluid and the material. Moisture content of the material is controlled in the processor independent of material temperature.

15 Claims, 2 Drawing Sheets

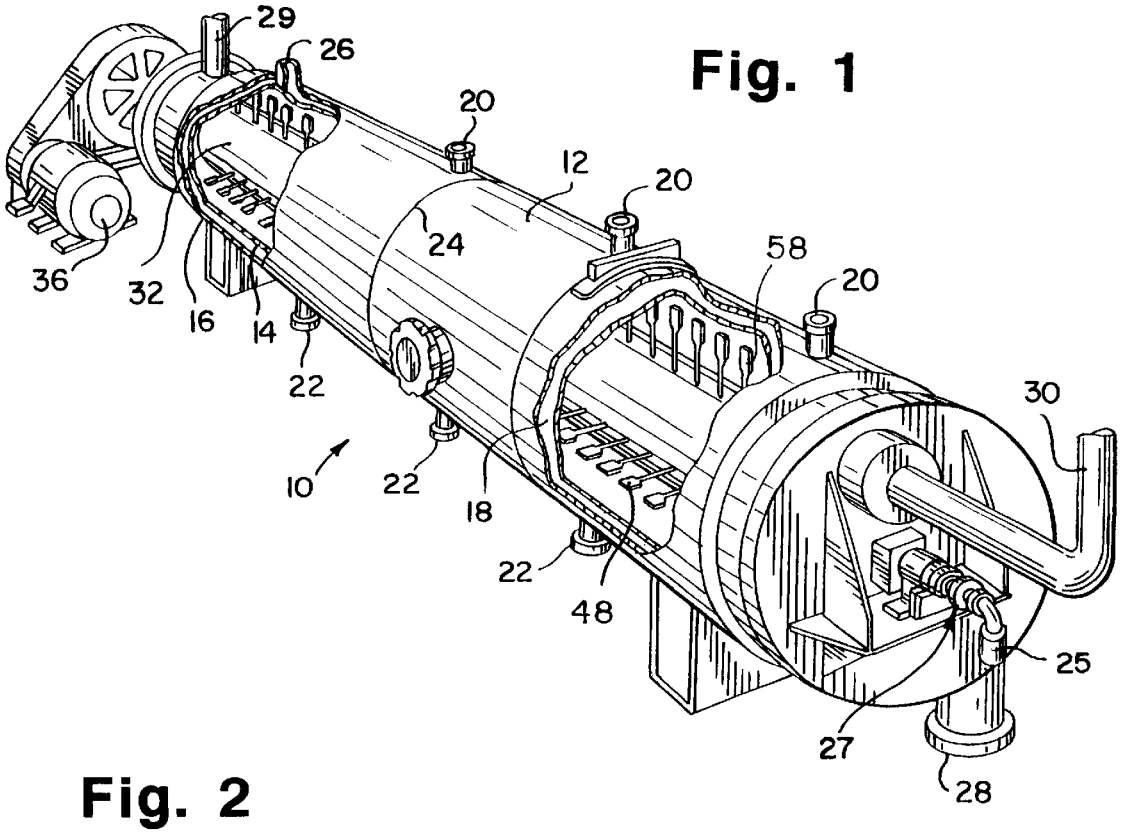
Fig. 1
Fig. 2
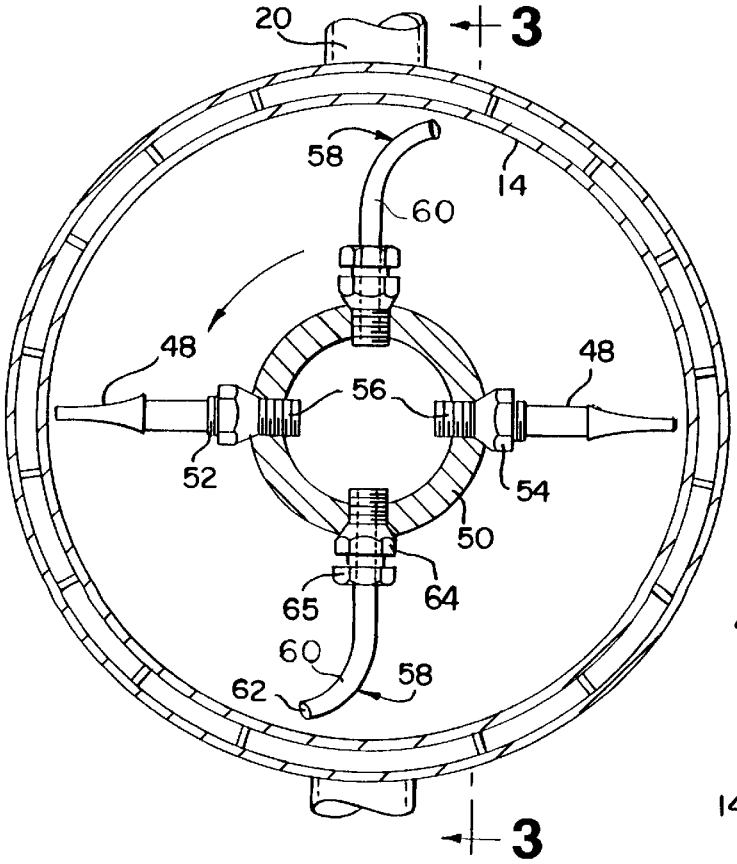
Fig. 3
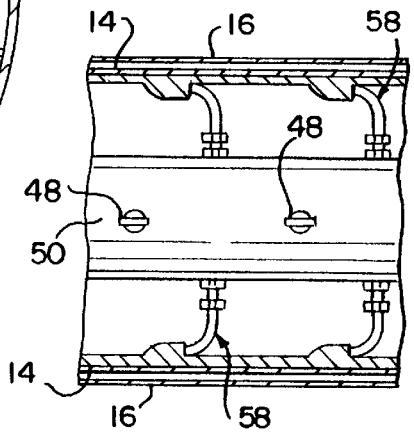

METHOD FOR TREATING STARCH AND STARCH-BEARING PRODUCTS

BACKGROUND OF THE INVENTION

This invention relates to a system for treating flowable food products in the course of drying, heating, reacting and cooking. More specifically, the present invention relates to a method and thermal processor which is well suited for thermal processing of starch and starch-bearing products whereby the material can be treated in some fashion in the course of its progression through an apparatus to achieve the desired reaction, for example, gelatinization, preconditioning, and other modifications before extrusion, final drying or further processing.

Starch and starch-bearing products are a staple of commerce and represent one of the main ingredients in a wide variety of food products. In commercial practice, the common technique for thermoprocessing of starch and starch-bearing products before extrusion, final drying, or further processing, is based on utilization of steam pressure cookers of the type generally described, for example, in the brochure 5430 of Andritz Sprout-Bauer Co. This process suffers from a number of disadvantages. Firstly, the step of preconditioning/thermal treatment of the product with the purpose of partial gelatinization and/or cooking of the starch is conducted in the pressurized vessel with live steam injection as the only source of heat supply to the product. Since the gelatinization reaction rate (or degree/percentage of gelatinization in the given thermal processing time) depends on the processing factors, such as temperature and product moisture content, the prior art methods based on the live steam injection in the cooker are incapable of precisely controlling the optimum correlation between the critical process parameters. This method will, therefore, not provide a required amount of gelatinized starch in different products to meet specific needs.

Another problem associated with the known process is a relatively long residence time due to inefficient heat and mass transfer in an insufficiently agitated paddle-type or screw processor that operates with a bed of material. As a result, the treated product is heterogeneous in terms of degree/percentage of gelatinization.

SUMMARY OF THE INVENTION

This invention involves new and efficient systems for treating starch and starch-bearing products, particularly the thermal processing of these heat and shear sensitive food materials. These materials are used in manufacturing many products ranging from snacks to pet food, and the starch and starch-bearing materials, mixed with water, have previously been thermally processed to provide gelatinization or other modifications before extrusion, final drying or further processing. It is fairly well accepted that when such starch-water preparations are heated, the changes in starch structure are usually called gelatinization.

This invention is based on the consideration that, for a given starch product (that is, for any given particulate type of starch-water preparation with specific particle size distribution, moisture content, etc.), there are three critical conditions for efficient gelatinization: the rate of heat transfer to and within material particles, the mass transfer of moisture within the particles, and the mass transfer of moisture from the particle surfaces to the surrounding atmosphere. In order to satisfy these conditions it is necessary to continually expose the surface area of material to heat energy at a high rate. It is also necessary to precisely control the moisture content of material and to cause the diffusion of water within the material particles in such a way as to provide a desirable transformation of the starch during gelatinization (cooking). These conditions are extremely difficult to attain with the heat and shear sensitive starch materials, particularly in view of the changing characteristics of the material during thermal processing.

The present invention provides a system for thermal processing of difficult-to-handle starches and starch-bearing products, this thermal processing system being efficient for cooking, partial gelatinization, modification, oxidation, sterilization, enzyme deactivation, or other transformations of starch-based products at a relatively low cost. According to this invention the starch or starch-bearing material is introduced to a high-intensity thermal processor of the type wherein there is a jacketed, horizontally extended barrel or cylinder through which an axially rotatable agitator extends. The material is introduced in a dry or moist state and preferably brought, before or after introduction, to a maximum hygroscopic moisture content or higher moisture content, and then maintained in this state during processing.

A processor of the type described in U.S. Pat. No. 5,271,163 can be successfully used for thermal processing of starch and starch-bearing products with precise control of the degree of starch gelatinization within the wide range of degree of gelatinization/cooking required. Systems of this type consist of an elongated cylindrical housing with an inlet for introducing material to the housing at one end thereof. The agitator includes a plurality of paddles which extend from the periphery of the rotatable agitator adjacent its axis of rotation and then outwardly towards the inner wall surface of the cylindrical housing. As described in the aforementioned patent, the cylindrical housing comprising the vessel is desirably jacketed to permit the circulation of heating medium adjacent the inside wall of the vessel. By introducing flowable starch and starch-bearing material at one end of the vessel, and by introduction of fluid, treatment of the material is achieved through heat exchange between the material, the fluid, and the inside wall. Different sections of a vessel, or vessels connected in series, can be maintained at different temperature to provide differing treatments for material introduced to the vessel or vessels.

As set forth in the prior disclosure, a plurality of nozzles are associated with the agitator along with a plurality of paddles. These nozzles are adapted to direct streams of fluid such as gas or liquid or combinations thereof. The gas, vapor or other fluid is directed into contact with the starch and starch-bearing material disposed on the inner wall surface of the vessel. The fluid will serve to establish and/or maintain a desired moisture level in the material. In addition, the turbulence imparted by the streams of fluid will serve to spread the material over a broad surface area of the inner wall and will achieve mixing action thereby maximizing the efficiency of the heat exchange between the inner wall surface and the material, as well as enhancing convective heat and mass transfer.

As will be explained in greater detail, steam is preferably the fluid directed into contact with the starch material. In that context, the present invention provides a combination of a) thermodynamical effects of the indirect heat supply method and live steam (humid gas) injection and b) mechanical and hydraulic shear forces created by the vigorously agitated thermal processor. These combined actions coupled with other defined processing conditions (such as controlled material moisture content, temperature and residence time) provide a very efficient method for treating starch and starch-bearing products.

BRIEF DESCRIPTION OF THE DRAWINGS

FIG. 1 is a perspective view of a thermal processing apparatus of the type useful for practicing the concepts of this invention;

FIG. 2 is a cross-sectional view of the processor employed for the practice of the invention viewed from the inlet end;

FIG. 3 is a reduced fragmentary sectional view of the processor taken about the line 3—3 of FIG. 2;

DETAILED DESCRIPTION OF THE DRAWINGS

Figure 4:
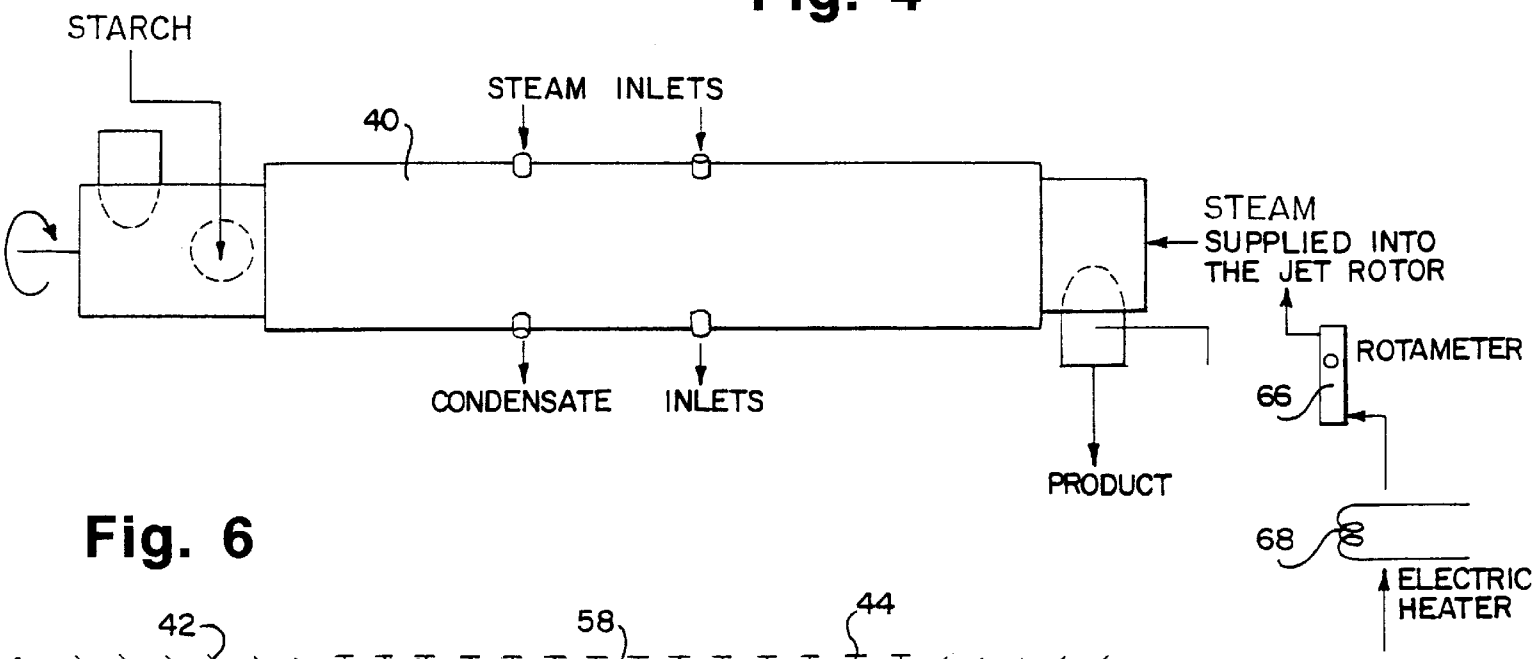
FIG. 4 is a diagrammatic illustration of a typical operation in accordance with the concepts of this invention.

FIG. 1 illustrates an apparatus 10 which includes an elongated cylindrical housing 12. This housing defines an inner wall 14 and an outer wall 16 whereby passages 18 are defined between the vessel walls. Thus, the outer wall 16 constitutes a spaced-apart jacket for the inner wall 14. Inlet fittings 20 are associated with the outer jacket whereby steam or other heat transfer media may be introduced into the passages 18 defined between the inner and outer walls. Outlet fittings 22 are provided whereby condensate or other media may be removed and whereby constant circulation around the inner wall of the vessel can be achieved.

As shown in FIG. 1, a parting line 24 may be defined between vessel sections so that one section may be maintained at a different temperature level than another section. More than two such sections are contemplated, and it is also contemplated that material exiting from the vessel shown in FIG. 1 may be passed to an adjacent vessel for continued treatment.

Material is introduced to the vessel 12 through inlet 26 and a material outlet 28 is provided at the opposite end of the vessel. As described in the aforementioned patent, the entire disclosure of which is incorporated herein by reference, it is contemplated that heated gas may be introduced with the material for circulation through the vessel. Under such circumstances, the gas may be introduced through inlet 26 or a separate inlet 29, and a discharge pipe 30 for vapor discharge is provided. This arrangement will result in gases flowing across the vessel and concurrent with the material.

Alternatively, the pipe 30 may be employed for the introduction of gases which will move countercurrent to the material and the separate pipe 29 may be employed for vapor discharge or this discharge may occur through inlet 26. This arrangement results in "counter-current" flow.

An agitator consisting of tubular rotor 32 and rows of paddles 48 is mounted for rotation within the vessel 12, and motor 36 is employed for driving the rotor. As explained in the aforementioned patent, the paddles extend outwardly from the rotor surface which is adjacent the axis of rotation of the rotor. The paddles extend to a point closely adjacent the inner surface of inner wall 14 whereby the paddles will serve to propel material from the inlet of the vessel along the length of the vessel and to the outlet of the vessel.

FIGS. 2 and 3 illustrate paddles 48 mounted on tubular rotor 50. The paddles 48 include threaded ends 52 which are received and adjustably supported on nuts 54. These nuts have an integrally formed threaded shaft portion 56 which permits rotation of the nuts relative to the rotor 50 for thereby adjusting the attitude of paddles 48.

The paddles 48 are adapted to be located in diametrically opposite lines extending along the length of rotor 50. Nozzles 58 are in turn located in a pair of lines 90 degrees offset from the paddles. Each of these nozzles includes a pipe section 60 terminating in open end 62. The adjustable nuts 64 and collars 65 support these pipe sections thereby permitting adjustment of the attitudes of the nozzles.

Fluid is adapted to be delivered to the rotor 50 for passage outwardly through the nozzles 58. As schematically illustrated in FIG. 4 and as shown in FIG. 1, the gas may comprise steam supplied to the rotor through pipe 25 leading to rotary joint 27.

Figure 5:
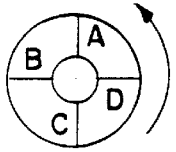
FIG. 5 is a diagrammatic view illustrating the agitator rotation for a system incorporating the features of the invention; and, FIG. 6 is a diagrammatic illustration of an example of paddle and nozzle attitudes which may be assumed when practicing the invention.
Figure 6:
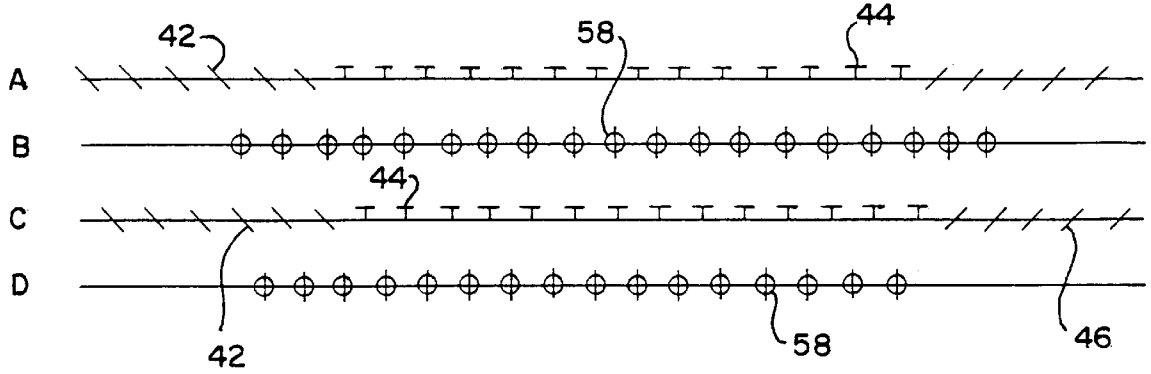

FIGS. 4, 5 and 6 illustrate an example of the application of this invention. In this instance, starch or starch-bearing products are being introduced to vessel 40 for purposes of processing the starch as described above. Heat is provided by means of steam introduced through inlets communicating with the space provided by the jacketed vessel design and an agitator assembly comprising a rotor with paddles and nozzles is employed for propelling the starch through the vessel. As shown in FIGS. 5 and 6, the paddles and nozzles are arranged in lines extending longitudinally of the housing. The lines comprise two lines of paddles, A and C, and two lines of nozzles, B and D.

The aforementioned patent refers to various options, such as the fact that nozzles and paddles may be integrally formed. This versatility in the apparatus 10 is particularly valuable for purposes of accomplishing a variety of processing methods on a variety of starches and starch-bearing products.

In the practice of the invention, a variety of conditions and considerations are applicable as follows:

1. Moisture content of the starch material is achieved and maintained at a maximum hygroscopic amount or higher moisture amount in order to provide the optimal controlled gelatinization condition and prevent an undesirable dehydration of material (preferable moisture content range for starch is 15–40% or higher).
2. This optimum range of material moisture content in the course of thermal processing is maintained by:
   a) Controlling the initial moisture content of the feed material;
   b) Injecting a saturated or superheated live steam or high humidity hot air and/or water into the thermal processing system using the nozzles 58; and,
   c) Controlling the indirect (conductive) heat transfer to the material through wall 14.
3. The required degree of thermal processing of starch and starch-bearing products (at given optimal moisture content) is provided by a combination of a heat transfer process and residence time control. The required residence time (preferably in the range of 10–30 seconds or longer) can be controlled by:
   a) Length of the processor 10;
   b) Speed of the rotatable agitators 32;
   c) Number of paddles 48 and their setting pattern; and,
   d) Rate of feed.
4. In order to provide an efficient operation of the thermal processing system in terms of material agitation, conveyance and relevant indirect (conductive) heat transfer conditions, the paddles 48 play an important role. The tips of the paddles extend adjacent wall 14, and the tip speed is preferably maintained at 500 ft/min or higher (preferably, 1000–1500 ft/min).

The paddle attitudes are readily changed for influencing residence time as well as effect on the material being processed.

5. As to the rate of heat transfer to the material particles and heating kinetics of the product in the course of thermal processing, in the practice of the method these critical factors can be controlled by:
   a) maintaining within desired limits the jacketed housing wall temperature and corresponding temperature differences which is a primary driving force in the indirect heat supply operation;
   b) maintaining within desired limits the speed of the rotatable agitator which provides a vigorous interaction of material and continually exposes the surface area of the material particles to the heat supply inner wall 14 of the housing; and
   c) introducing and controlling the flow rate of live steam or hot humid fluid through the agitator nozzles 58.

Based on the foregoing and other test data, the thermal processing of starch and starch-bearing products according to the present invention can be conducted by maintaining the temperature of the inner wall 14 at 80° C. and higher, preferably at 100–150° C.

A wet cake of starch material is preferably introduced to the processor at the desired maximum hygroscopic amount or higher moisture content. In this case, fluid from nozzles 58, preferably steam, will be used to maintain the desired level. The live steam or hot humid gas can be introduced in the system at atmospheric pressure or higher, preferably at 3–10 psi but even at higher pressure depending on the processor capabilities. Such steam or hot humid gas can be heated to temperatures conventionally used for food processing operations, that is, up to 250° C.

In applications where the moisture content of the feed material is lower than the desirable maximum or higher hygroscopic moisture content, moisture may be added through the nozzles 58.

The rapidly exposed surfaces of the material particles (caused by the action of the agitator) enables the steam or hot humid fluid issuing from the nozzles to improve heat transfer to the material. Thus, as a result of the relatively high peripheral speed of the agitator, mechanical forces are applied through the agitator's paddles to move individual particles and layers of material in an annular spiral path; the resultant forces include components in directions circularly, laterally and radially. Paddles of the agitator, as well as the high velocity jet streams of steam or humid fluid discharged from the nozzles, create turbulence in the material layer and invert the individual particles so as to change their direction, path of travel and velocities. Resilient mechanical shear forces imparted by the agitator, as well as hydraulic shear forces created by the particles in the material slipping on each other by their different velocities, are applied to the shear-sensitive starch and starch-bearing products over a relatively short period of time.

Since the vigorously agitated material being processed in the indirect heat supply thermal processor can be heated by heat conduction into the particles by the hot metal walls 14 of the jacketed housing, the wet solid layer adjacent to the heat transfer surface is heated above the liquid boiling point over an extremely short period of time. The superheating may cause some degree of expanding and cracking of the particles, in addition to the great expansion of liquid to vapor. There is also reconditioning of vapor due to adjacent cool particles since only a small portion of the wet solid layer is in close proximity with the hot surface of inner wall 14. This combination of mechanical and hydraulic shear forces along with thermal stress can cause both mechanical and thermal degradation of starch, including transformations such as partial cooking or gelatinization when some of the starch granules have ruptured.

In the vigorously agitated thermal system described where the agitator brings cooler, wet particles continuously into contact with the heating surface, the mechanical shear forces and thermal stress combine to make uniform the stresses for each particle whereby, as a result of the uniform work input, uniform heating kinetics and uniform shear stress, a uniform and predictable degree of gelatinization throughout the complete stream of this shear and thermal stress sensitive material(s) is provided. Therefore, a combination of vigorous agitation, indirect heat supply and live steam (or hot, humid fluid) injection through the nozzles 58 incorporated in the agitator provides, rapid, improved, controllable and efficient thermal treatment for the difficult-to process and difficult-to-handle starch and starch-bearing products.

In addition to efficient thermal processing, the system also provides a means of precise mass transfer control between a starch, or starch-bearing material, and a reaction agent. In the case of gelatinization, it is important to control the rate of water transfer between the starch and the process environment. Control of the cooking process relies on the ability to control the amount of water in the starch granule at any given point during the process. In prior art systems, the application of heat has a great effect on the water content within the material, so control of both material temperature and its moisture content is impossible. In the thermal processing system described here, however, the moisture content can be maintained independent of the temperature of the material. This is critical for producing a uniform product. In this case, the use of the nozzles to inject steam or humid fluid at a controlled flow rate maintains desired material moisture content. Further, the uniform treatment which is obtained by means of the plurality of spaced apart nozzles ensures that each particle maintains its desired moisture content continually throughout the process.

The thermal system according to the present invention can also be utilized as a processor or reactor for different types of starch transformation or modification. For these applications the nozzles may be used to provide gas or liquid as additions or reaction agents in any zone of the bed of material being processed. For example,

- acid-modified starch may be produced by addition of diluted mineral acid.
- oxidized starch may be produced if a strong oxidizing agent is used such as sodium hypochlorite in a caustic (sodium hydroxide) solution.
- dextrins may be produced by dry roasting of unmodified starch (using for instance, hot oil circulating through the jacket) with addition of acid or alkaline catalyst.
- starch derivatives (cross-linked or stabilized) may be produced by adding a difunctional agent (which creates bonds between hydroxyl group on different starch molecules) or a highly specific agent to the hydroxyl group on the starch molecule.
- sterilization and/or enzyme deactivation of starch-bearing materials may be accomplished by a combination of indirect heating in a saturated or superheated steam environment.

The system of the invention permits selective use of nozzle means, that is the number of nozzles and their setting pattern. The temperature and pressure of gas, steam or liquid issuing from the nozzles may differ from one control zone to another. The nozzle means may be used to inject multiple liquids and/or vapors in the same working area. Local temperature control or adjustment of material moisture (or reagent) content in the work areas may be employed to prevent, for instance, undesirable drying of heated starch in the course of a partial gelatinization process.

In another possible application of the use of this system as a reactor, a high mass transfer rate may be desired to uniformly treat the material with a reagent that is introduced into the system separate from the material. In this case, uniform, and controllable interaction between the reagent in the reaction environment and the material is required for optimal process control. Again, the use of a plurality of installed-in-a-specific-pattern nozzles as a means of introducing the reagent into this vigorously agitated system allows for rapid, uniform, controllable treatment.

It will be understood that various changes and modifications may be made in the concept of invention described without departing from the spirit of the invention particularly as defined in the following claims.

What is claimed is:

1. A method for treating starch and starch-bearing material which comprises providing a thermal processor comprising a housing defining an inner wall surface, an inlet end, an outlet end, an agitator rotatable within the housing adapted to direct the material into contact with the inner wall surface, means for heating the inner wall surface, and nozzles associated with the agitator for discharging fluid from the nozzles into contact with the material during rotation of the agitator, and including the steps of introducing said material to said processor at said inlet end, heating said inner wall surface to a temperature for achieving treatment of said material, achieving and maintaining at least a maximum hygroscopic moisture content in said material, controlling the fluid discharge from said nozzles to create turbulence for spreading the material over a broad surface area of said inner wall surface to enhance and render substantially uniform the heat exchange between said material, said fluid and said inner wall surface, and to control material mass content and mass transfer between said material and said fluid, and removing said material from said outlet end.

2. A method according to claim 1 wherein said material is introduced to the processor in the form of a wet cake.

3. A method according to claim 1 wherein said material is introduced to the processor in a dry state and including the step of adding moisture to the material in said processor.

4. A method according to either of claims 2 or 3 wherein the moisture content of the material is maintained between from 15 to at least about 40% by weight.

5. A method according to claim 1 wherein said fluid comprises steam.

6. A method according to claim 5 wherein said steam is maintained at temperatures up to 250° C.

7. A method according to claim 1 wherein said agitator is employed for propelling said material from said inlet end to said outlet end of said processor.

8. A method according to claim 7 wherein said agitator supports paddles for imparting a mixing action to said material and for propelling said material.

9. A method according to claim 8 wherein said paddles extend adjacent said inner wall, and including the step of imparting a tip speed to said paddles of at least 500 ft./min.

10. A method according to claim 1 wherein said fluid is selected from the group consisting of saturated or superheated steam, high humidity hot air and hot water.

11. A method according to claim 1 including the step of maintaining the temperature of said inner wall at at least 80° C.

12. A method according to claim 10 wherein the temperature of said inner wall is maintained at a temperature between 100 and 175° C.

13. A method according to claim 1 including the step of adding reaction agents to the fluid discharged from said nozzles.

14. A method for treating starch and starch-bearing products which comprises forming the products into a wet cake material containing at least a maximum hygroscopic amount of moisture, providing a thermal processor comprising a housing defining an inner wall surface, an inlet end, an outlet end, an agitator rotatable within the housing adapted to direct the material into contact with the inner wall surface, means for heating the inner wall surface, nozzles associated with the agitator means for discharging fluid from the nozzles into contact with the material during rotation of the agitator, and including the steps of introducing said material to said processor at said inlet end, heating said inner wall surface to a temperature for achieving treatment of said material, achieving and maintaining at least a maximum hygroscopic moisture content in said material, controlling the fluid discharge from said nozzles to create turbulence for spreading the material over a broad surface area of said inner wall surface to enhance and render substantially uniform the heat exchange between said material and said inner wall surface, and removing said material from aid outlet end.

15. A method for treating starch and starch-bearing material in a thermal processor, the processor including a housing having an inner wall surface, an inlet end, an outlet end, an agitator rotatable within the housing adapted to direct the material into contact with the inner wall surface, means for heating the inner wall surface, and nozzles associated with the agitator for discharging fluid from the nozzles into contact with the material during rotation of the agitator, said method comprising the steps of:

a. introducing said material to said processor at said inlet end, b. heating said inner wall surface to a temperature for achieving treatment of said material, c. controlling the fluid discharge from said nozzles:

i. to create turbulence for spreading the material over a broad surface area of said inner wall surface to enhance and render substantially uniform the heat exchange between said material, said fluid and said inner wall surface, and ii. to control material mass content and mass transfer between said material and said fluid, and d. removing said material from said outlet end.

* * * * *